United States Patent [19]

Eriksson

[11] 4,227,869

[45] Oct. 14, 1980

[54] INTERMESHING PUMP ROTOR GEARS WITH INVOLUTE AND LINEAR FLANK PORTIONS

[75] Inventor: Sven E. Eriksson, Örebro, Sweden

[73] Assignee: Atlas Copco Aktiebolag, Nacka, Sweden

[21] Appl. No.: 842,559

[22] Filed: Oct. 17, 1977

[30] Foreign Application Priority Data

Oct. 19, 1976 [SE] Sweden ..... 7611579

[51] Int. Cl.[3] ..... F04C 2/18

[52] U.S. Cl. ..... 418/206

[58] Field of Search ..... 418/190, 205, 206

[56] References Cited

U.S. PATENT DOCUMENTS

| | | | |
|---|---|---|---|
| 325,276 | 9/1885 | Roots | 418/206 |
| 3,089,638 | 5/1963 | Rose | 418/206 |
| 3,640,650 | 2/1972 | Wydler | 418/206 |

FOREIGN PATENT DOCUMENTS

| | | | |
|---|---|---|---|
| 861733 | 1/1953 | Fed. Rep. of Germany | 418/206 |
| 741835 | 12/1932 | France | 418/206 |

*Primary Examiner*—John J. Vrablik

*Attorney, Agent, or Firm*—Eric Y. Munson

[57] ABSTRACT

A pair of rotors for a rotary piston pump or blower is disclosed. The rotor flanks comprise an involute section for cooperation with a similar section on the other rotor. Inside the involute section the flank comprises a circular arc portion. Outside the involute section the flank comprises a substantially linear part resulting in reduced flow losses at high rotational speeds without the creation of a blow-hole between the outlet and the inlet of the machine.

4 Claims, 5 Drawing Figures

INTERMESHING PUMP ROTOR GEARS WITH INVOLUTE AND LINEAR FLANK PORTIONS

SUMMARY OF THE INVENTION

The present invention relates to a pair of rotors for a rotary piston pump. More specifically the invention concerns a profile design of the flanks of the rotor lands giving a high efficiency at fairly high rotary speeds.

According to the present invention each rotor is provided with at least two lands and intervening grooves which are parallel to the axis of rotation. Each land comprises a flank which along a part of its length has the form of an involute for cooperation with a corresponding part of the other rotor. Inside the involute section the flank is formed substantially as an arc of a circle. Outside the involute section the flank is formed such that it passes the bottom of a groove in the other rotor with a play which is considerably greater than the play between the involute sections.

Since sealing cooperation between the rotors is achieved only along a portion of the tip of the lands, a comparatively slight variation of the torque to which each rotor is subjected by the gas forces is created. This torque always has the same direction. This results in an even running of the machine. Since the lands outside the involute sections are formed such that they pass the grooves in the other rotor with a considerable play, over-compression between the rotors is avoided without the creation of a blow-hole between the outlet and the inlet of the machine. A further advantage is that only a portion of each flank of the lands need be manufactured with high precision. Since the sealing between the rotors and between each rotor and the machine housing is obtained by different portions of the flank of the land these parts can be designed for optimum function independent of each other. Sealing in this connection means that the play between cooperating parts is small. The play between the involute sections of the rotors is for example 0.3 mm if the rotor radius is about 100 mm.

BRIEF DESCRIPTION OF THE DRAWINGS

An embodiment of the invention is described below with reference to the accompanying drawings in which.

DESCRIPTION OF A DETAILED EMBODIMENT

Figure 1:
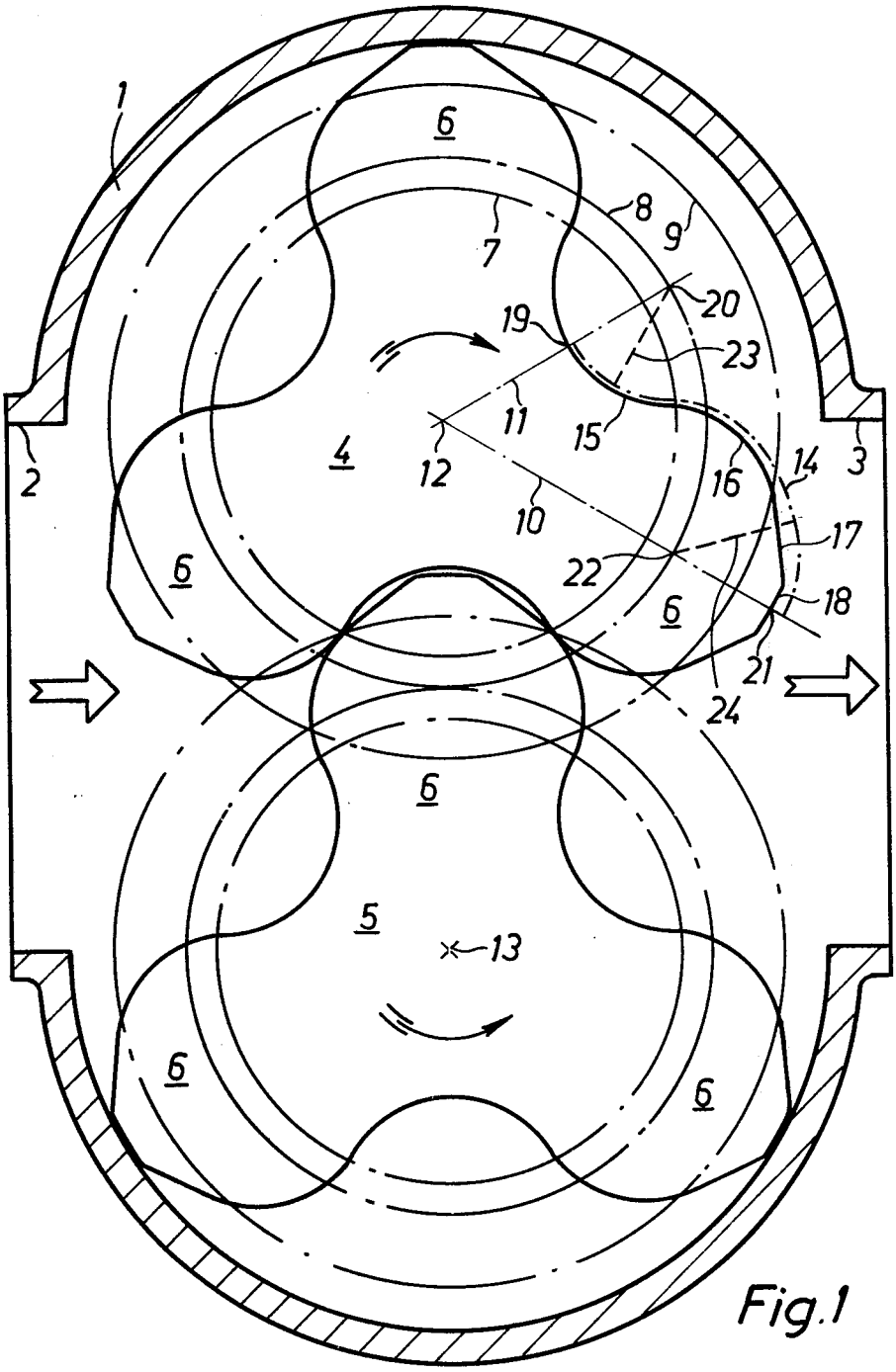
FIG. 1 shows a section through a rotary piston pump.

The rotary piston pump shown in FIG. 1 comprises a machine housing 1 in which two rotors 4 and 5 are journalled for rotation about parallel rotation axes 12, 13. When the rotors rotate as shown by means of arrows in FIG. 1, gas is conducted from the inlet 2 to the outlet 3. The rotors are driven by a driving motor (not shown) directly or via a gear box in a manner well-known in the art. The machine is furthermore provided with a not shown synchronizing gear for synchronizing the speeds of the rotors.

Each rotor 4, 5 is provided with three lands 6 which are parallel with the rotation axes 12, 13. The rotors are, between the lands, provided with grooves through which the lands of the other rotor can pass. Since each land is symmetric relative to a radial line 10 through the summit of the land only one flank need be described.

The flank of the land has been formed according to a hypothetical profile 14. If both rotors are designed with the hypothetical profile they would mesh without any play. The profile 14 comprises a circular arc portion having its centre in the point 20 on the pitch circle 8 and extending from the radial line 11 through the bottom 19 of the groove and the point 20 to the root circle 7. The profile 14 furthermore comprises an involute section extending from the root circle 7 to the crest circle 9. Outside the crest circle 9, the profile 14 comprises a circular arc portion having its centre in the point 22 which is the point of inersection between the pitch circle 8 and the radial line 10 through the tip 21 of the land 6. Radii 23, 24 have been introduced into the figure to mark the circular character of the circular arc portions.

In order to obtain the necessary play between the rotors during operation in order to secure a good function, e.g. when the temperature varies, the flank of the land has been modified relative to the hypothetical curve 14 as shown in FIG. 1. The curve 15, 16, 17, 18 comprises a substantially circular arc portion 15 extending from the point 19 to the root circle 7. Between the root circle 7 and the crest circle 9, the flank comprises an involute section 16. Outside the crest circle 9 the flank of the land comprises a substantially linear portion 17 and a curved portion 18. The deviation between the flank 15, 16, 17, 18 and the hypothetical curve 14 has been exaggerated in FIG. 1 for clarification purposes. The distance between these curves is practically constant from the point 19 to the crest circle 9. Outside the crest circle 9 the distance increases considerably. The distance is about 8–9 times as large at the tip 21 of the land as at the involute section 16. Because of this, the portion outside the crest circle 9 will pass a groove in the other rotor with a play which is considerably greater than the play between cooperating involute sections. The crest of the land can thus be designed entirely with its cooperation with the machine housing 1 in mind.

Figure 2:
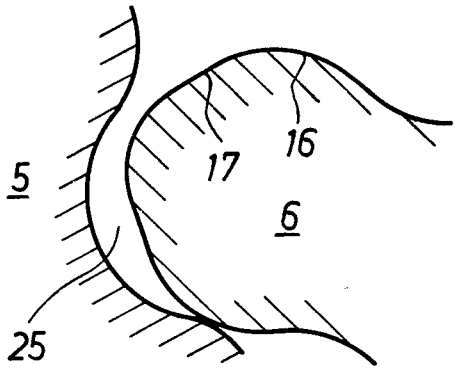
FIGS. 2–5 show partial sections through the rotors with the rotors in different angular positions.
Figure 3:
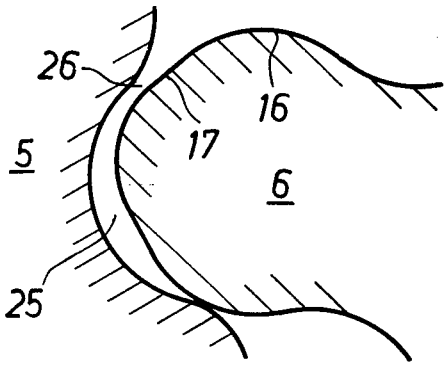
Figure 4:
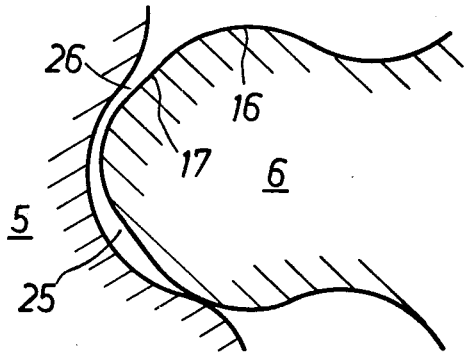
Figure 5:
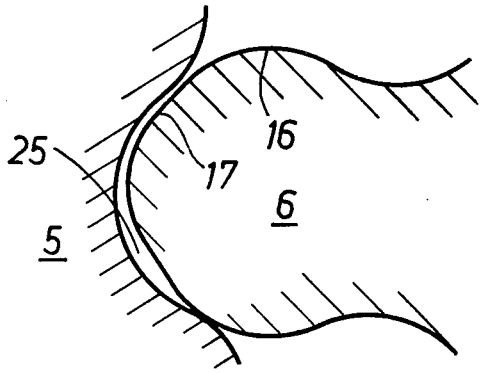

FIGS. 2–5 show in greater detail how a land 6 meshes with a groove in the other rotor. In all these figures there is a sealing cooperation between the involute section at the bottom of the figure. In FIG. 2 the rotors are shown in an angular position where a land 6 just enters a groove in the other rotor 5. Gas can hereby easily pass out from the chamber 25. The land 6 has in FIG. 3 penetrated deeper into the groove. Since the land 6 is provided with a substantially linear portion 17 the slot 26 between the rotors is, in this position as well as in the one shown in FIG. 4, so wide that gas easily can flow out from the chamber 25 even at comparatively high rotational speeds. The flank portion 17 does not have to be perfectly linear but can be somewhat curved. The expression substantially linear as used in this application regarding flank portion 17 means that flank part 17 may deviate from the straight line shown in the FIGS. with a maximum distance being 1.5% of the rotor diameter. A machine having a deviation of 1.15% has been tested with good results. However, it is expected that the optimum deviation varies somewhat with the size of the machine. The distance between the straight line 17 in FIG. 1 and the hypothetical curve 14 is about 2.4% of the rotor diameter. What must be born in mind when calibrating the part 17 is that the slot 26 should be wide so that a high efficiency is obtained for high rotational speeds. In FIG. 5 the rotors are shown in an angular position they take shortly before the involute section 16 comes into sealing cooperation with a corresponding section on the other rotor. An essential feature of the invention resides in the fact that sealing cooperation is maintained between the involute sections in the lower part of the figure until sealing cooperation is achieved between the involute sections in the upper part of the figure. In this way the creation of a blowhole between the outlet and the inlet of the machine is avoided. Since the flanks of the lands have been provided with substantially linear portions 17, a small increase of the gas volume is obtained which increased volume is conducted back to the inlet side of the machine. This drawback is, however, of no importance in practice since the pressure increase in a blower is moderate. Since both flanks of the lands are provided with substantially linear portions 17, only small flow losses result when the land 6 emerges from the groove in the other rotor. In this way only a moderate pressure decrease occurs in the chamber 25 during the suction phase.

The above described and in the drawings shown embodiment of the invention is only to be regarded as an example which can be modified within the scope of the subsequent claims.

What I claim is:

1. A pair of intermeshing rotor gears for a rotary piston pump comprising at least two lands, each defining a root and a crest and intervening grooves, which lands rotate within a pump housing about a pair of spaced parallel axes defining the pitch circles (8) of the gear rotors, each of said lands having symmetrically profiled leading and trailing flanks describing a root circle (7) and a crest circle (9), said profiles comprising: a circular arc portion (15), an involute portion (16) merging with said circular arc portion and a substantially linear portion (17) extending from said involute portion and merging in a terminal portion cooperating with the wall of the pump housing, said involute portion and said linear portion being calibrated to maintain sealing cooperation between the involute portion of the leading flank of one of said rotor gears and the involute portion of the trailing flank of the other one of said rotor gears substantially where said flanks intersect the root circle until sealing cooperation is established between the involute portion of the trailing flank of said one gear rotor and the involute portion of the leading flank of said other rotor to thereby prevent leakage of working medium and overcompression thereof between rotor lands during rotation thereof.

2. A pair of intermeshing gear rotors according to claim 1, in which said circular arc portion (15) has its radius centered on the pitch circle (8) and extends to a point on the root circle (7) of the flank, where it merges with the involute portion which extends to a point on the crest circle (9), where it merges with said substantially linear portion.

3. A pair of gear rotors according to claim 1, in which said gear rotors comprise three intermeshing lands and three intervening grooves.

4. A pair of rotor gears according to claim 1, in which the terminal portion of said substantially linear portion has a curved profile for sealing cooperation with the wall of the pump housing.

* * * * *